US008205803B2

(12) United States Patent
Couvreur et al.

(10) Patent No.: US 8,205,803 B2
(45) Date of Patent: Jun. 26, 2012

(54) DEVICE FOR FASTENING RAILWAY RAILS

(75) Inventors: Thierry Couvreur, Braine l'Alleud (BE); Michel Lens, Beersel (BE)

(73) Assignee: HF Holding S.A., Nivelles (BE)

( * ) Notice: Subject to any disclaimer, the term of this patent is extended or adjusted under 35 U.S.C. 154(b) by 192 days.

(21) Appl. No.: 12/669,642

(22) PCT Filed: Jul. 18, 2008

(86) PCT No.: PCT/EP2008/059453

§ 371 (c)(1), (2), (4) Date: Jan. 19, 2010

(87) PCT Pub. No.: WO2009/013239

PCT Pub. Date: Jan. 29, 2009

(65) Prior Publication Data

US 2010/0193598 A1 Aug. 5, 2010

(30) Foreign Application Priority Data

Jul. 20, 2007 (EP) ..... 07112883

(51) Int. Cl.
*E01B 9/30* (2006.01)

(52) U.S. Cl. ..... 238/351; 238/347

(58) Field of Classification Search ..... 238/331–334, 238/347, 349, 351, 361–364
See application file for complete search history.

(56) References Cited

U.S. PATENT DOCUMENTS 1,011,245 A * 12/1911 Rafter ..... 238/107
2,636,687 A * 4/1953 Arnold et al. ..... 238/292
4,193,544 A * 3/1980 Marchant et al. ..... 238/347
4,251,030 A 2/1981 Marchant
4,889,282 A * 12/1989 Marchant ..... 238/347

FOREIGN PATENT DOCUMENTS

| | | |
|---|---|---|
| BE | 843.657 | 10/1976 |
| EP | 0272874 A1 | 6/1988 |
| FR | 2.220.625 | 3/1974 |
| GB | 1544633 | 4/1979 |
| WO | WO 01/66858 A1 | 9/2001 |

* cited by examiner

*Primary Examiner* — S. Joseph Morano
*Assistant Examiner* — Zachary Kuhfuss
(74) *Attorney, Agent, or Firm* — Reinhart Boerner Van Deuren P.C.

(57) ABSTRACT

The present invention relates to a fastening device (100) for fastening a railwayrail (10) onto a support (4), comprising a primary element (101) and a secondary element (102). The secondary element (102) corresponds to nut and bolt fasteners comprising at least one nut and one screw (9) with a screw body (82) and a screw head. The primary element (101) comprises at least one part (1,2) with an upper surface and lower surface, said part being crossed in its thickness by at least one aperture (80) able to receive said screw (9). Said aperture (80) is formed by a first recess (8) located on the upper surface of said part and intended for receiving the screw body and a second recess (8) located on the lower surface of said part and intended for receiving the screw head. According to the invention, the upper surface of the lower part is inclined according to a first slope (12) and the lower surface of the upper part is inclined according to a second slope (14), the first slope and the second slope being complementary. According to the invention, the upper part comprises means (81) for tilting the screw, said means located on the edges of the first recess.

25 Claims, 15 Drawing Sheets

DEVICE FOR FASTENING RAILWAY RAILS

CROSS-REFERENCE TO RELATED PATENT APPLICATIONS

This patent application is the National Stage of International Application No. PCT/EP2008/059453, filed Jul. 18, 2008, that claims the benefit of European Application No. 07112883.9, filed Jul. 20, 2007, the entire teachings and disclosure of which are incorporated herein by reference thereto.

FIELD OF THE INVENTION

The present invention relates to a device for fastening a railway (or railroad) rail, and in particular to a device for fastening a railway rail subject to very heavy loads such as a rail for a bridge crane or harbor crane.

The present invention also relates to parts making up said fastening device, and by extension covers any system comprising said device, and notably which comprises at least said device and the railway rail.

The present invention also relates to the method for manufacturing such a device.

BACKGROUND OF THE INVENTION

Devices for fastening rails such as railway rails or runways, are well known. They are preferably used by pairs, the devices of each pair being positioned opposite to each other, on either side of the foot of said rails, in order to fasten them to the surface of a preferably planar support.

According to the state of the art, a distinction is made between different types of fastening devices, fastening devices to be bolted and fastening systems to be welded. The present invention is more specifically set within the scope of fastening devices to be bolted, and even more specifically within the scope of so-called flexible fastening devices. The latter, which are also commonly called "fastening clips", consist of at least two elements, so-called "primary element" and "secondary element".

The "primary element" generally comprises two parts. The first part is supported on the support and is firmly fastened thereto. The second part allows confinement of the rail, and more particularly of the sole or the foot of the rail, for example by having an overhanging side surface which comes into contact with the sole or the foot of the rail.

The "secondary element", which defines the type of fastening here, is a means for fastening the first and second parts to each other. Generally, the means for fastening comprise at least one screw, the head of which is introduced into an aperture present in the first and in the second element and onto which a nut will be fastened. Any nut and bolt fasteners, in particular including washer(s) which may be associated with them, are more globally grouped as secondary elements.

Further, it will be noted that the side surface of the second part of the primary element, which overhangs and comes into contact with the sole or the foot of the rail, may have an elastomeric nose. The presence of this nose allows some vertical flexibility, particularly adapted to absorbing the stresses induced by the passing of the rollers of the vehicles rolling along the rail. In other words, by means of these clips, the rail is not totally restrained, since it is firmly held sideways but it retains the capability of moving vertically within certain limits.

In certain cases, the primary element may also only consist of a single part, the screw (secondary element) then having to cross the support on which this part rests. The support, which most often is a metal beam, may be bored through for this purpose.

The use of a continuous rubber strip or pad, which is placed under the support of the rail, jointly with that of these clips, contributes to providing under operating conditions, a certain vertical flexibility of the rail and thereby obtaining a flexible fastening of the rail.

In order to obtain a proper assembly by which the required tightening may be guaranteed for perfect fastening of the rail to its support, it is imperative to position the fastening means very accurately.

The advantage of this type of systems is that it may be adjusted and relatively easily disassembled.

Further, this solution is particularly advantageous in the case of significant loads or in the case of particularly severe utilization rates as in the case of continuous operation of cranes.

For that matter, in the particular case of cranes or bridge cranes, this type of fastening further has certain technical drawbacks, related to the occurrence of new additional specific constraints for these applications.

Indeed, (harbor) cranes and bridge cranes are presently both heavier, higher and bulkier than previously. Further, they move and operate more rapidly. Comparatively, the number of wheels and their diameters do not increase in proportion, which has the effect of increasing the load per wheel of those cranes and bridge cranes.

Consequently it is seen that the rails and therefore the fastening systems are subject to new mechanical stresses, essentially from vibrations, to which they have to be able to respond.

In concrete terms, the vibrations cause rotation of the rail, which causes stresses and play at the fastening systems and thereby even wear or unscrewing of the parts.

To these mechanical stresses are added those generated by defects during laying (a poorly applied clip against the rail, bad engagement of the screw, . . . ) which also cause play to occur at the fastening systems and at the rail over elapse of time.

AIMS OF THE INVENTION

The present invention aims at proposing a solution which overcomes part or all the drawbacks reported above.

More particularly, the present invention aims at proposing a fastening device comprising a novel clip and suitable nut and bolt fasteners and which may be used for rails for cranes and/or bridge cranes having particularly high loads, and in particular larger than 100 tons.

Another object of the invention is to propose a fastening device for such rails (railtracks or runways, but more generally also tracks) which may easily and simply be assembled/disassembled while providing maximum safety.

Finally, the present invention aims at proposing a fastening device with minimum bulkiness.

SUMMARY OF THE INVENTION

Aims of the invention are met by providing a device for fastening a rail as set out in the appended claims.

The present invention relates to a (flexible) fastening device (or clip) for fastening (firmly fastening) a railway rail (runway, railtrack or track) or on a support, comprising a primary element and a secondary element. The secondary element relates to nut and bolt fasteners. The secondary element comprises at least one nut and one screw, the screw comprising a screw body and a screw head. The primary element comprises at least one part (preferably two) with an upper surface and a lower surface, said part being crossed in its thickness by at least one aperture adapted to receive said screw.

Said aperture is formed by a first recess, so-called "upper recess", located on (at) the upper surface of said part and intended for receiving the screw body of said screw, and a second recess, so-called "lower recess", located on (at) the lower surface of said part and intended for receiving the head of the screw.

On the edges of the upper recess means are provided for tilting the screw. The screw is tilted along a certain slope of inclination relatively to the plane of the upper surface.

Preferably, the means for tilting the screw are such as to create, when the device is fastened on the rail, a horizontal component at the force which is exerted on the screw in the direction of the rail.

The tilt of the screw itself has the effect of sliding (pushing) the primary element towards the rail.

Advantageously, the primary element comprises two at least partially superposable parts, one part, so-called "lower part " and a part, so-called "upper part".

Each one of the upper part and the lower part has an upper surface and a lower surface. The upper part and the lower part are crossed in their thickness by at least one aperture adapted to receive said screw.

The aperture is formed by a first recess, located on the upper part and configured for receiving the screw body of said screw, and a second recess, located on the lower part and configured for receiving the screw head.

Advantageously, the upper surface of the lower part is inclined according to a first slope and the lower surface of the upper part is inclined according to a second slope. The first slope and the second slope both have a complementary inclination.

The term complementary inclination (or complementary slope) refers to one slope compensating the other slope.

Therefore, the idea of the present invention is to design a fastening device which, once it is mounted, not only exerts an essentially vertical force on the screw (perpendicularly to the plane of the support), but tends to cause the occurrence of a new preferably horizontal component, so as to tilt the screw (make it lean) in the direction of the rail and to thereby slide the primary element in the direction of the rail.

A better fastening of the rail to its support is thereby obtained.

The axis of the upper recess and the axis of the lower recess coincide (same common central axis for both recesses).

Preferably, the means for tilting the screw are configured to tilting the screw over an angle falling in the range between 1° and about 45°, preferably between about 1° and about 30°, and preferably between about 1° and about 15°, and preferably between about 5° and about 45°, and preferably between 5° and 30°, and preferably between 5° and 15°.

Preferably, the inclination angle of the first slope falls in the range between 1° and 45°, preferably between 1° and 30°, and preferably between 1° and 15°, and preferably between 5° and 45°, and preferably between 5° and 30°, and preferably between 5° and 15° with reference to a plane formed by the support.

Preferably, the inclination angle of the first slope and the tilt angle of the screw by the means for tilting have a same value. Alternatively, said angles have different values.

According to an embodiment of the invention, the tilting means (the tilting element) are an integral part of the upper surface of the (upper) part.

According to another embodiment, the tilting means (the tilting element) correspond to one or more different portion(s) of the part forming the primary element.

The means for tilting the screw can hence form a unitary piece with the upper part. Alternatively, the means for tilting the screw can be formed of one or more parts being distinct (i.e. removable) from from the upper part.

The tilting element (the positioning means) may assume different shapes. The tilting element may thus for example assume the shape of a bulge present on the edges of the upper surface (edges of the first recess) of the (upper) part.

The tilting element may also assume the shape of a spring present on the edges of the upper surface (edges of the first recess) of the (upper) part.

Other shapes are further possible for the tilting means, such as notably a set of bias shims or a compressible shim.

Preferably, the second recess comprises abutments configured for blocking the head of the screw when the device is mounted.

Preferably, said abutments are tilted along a tilted slope relative to the horizontal or to a base plane of the lower part or the support.

It should be understood that in this case, the means for tilting the screw can comprise said abutments which are tilted along a certain tilted slope parallel to the tilted slope of the tilting element.

Preferably, the upper surface of the upper part comprises a portion which protrudes beyond the lower surface of said part and is able to come into contact with the sole of the rail when the device is fastened to the rail.

Preferably, said portion has a flexible more preferably elastomeric member, configured for establishing contact with the sole of the rail when the device is fastened to the rail. One skilled in the art may refer to an analogous device described in document WO-A-01/66858 of the Applicant.

Preferably, the lower (second) recess has an introduction area, through which the screw is introduced into the recess in an initial position, and a tightening area, corresponding to a final position of the screw which allows blocking and tightening of said screw, when the latter is positioned therein.

According to an embodiment, passing the screw into the lower recess from the introduction area to the tightening area is accomplished by rotation.

According to another embodiment, passing the screw into the lower recess from the introduction area to the tightening area is accomplished by translation.

Alternatively, passing the screw into the lower recess from the introduction area to the tightening area is accomplished by rotation and translation.

The present invention also relates to a (flexible) fastening device (or clip) for fastening a railway rail on a support, comprising a primary element and a secondary element. The secondary element corresponds to nut and bolt fasteners comprising at least one nut and one screw with a screw body and a screw head. The primary element comprises at least one part with an upper surface and a lower surface, said part being crossed in its thickness by at least one aperture able to receive said screw. Said aperture is formed by a first recess, so-called "upper recess", located on (at) the upper surface of said part and intended for receiving the screw body of said screw, and a second recess, so-called "lower recess", located on (at) the lower surface of said part and intended for receiving the head of the screw, the lower recess having an introduction area, through which the screw is introduced into the recess in an initial position, and a tightening area, corresponding to a final position of the screw which allows blocking and tightening of said screw, when the latter is positioned therein.

Preferably, the lower recess of the part comprises abutments located at the tightening area (21) and designed for blocking the head of the screw when the device is mounted.

Passing the screw into the lower recess from the introduction area to the tightening area may be accomplished either by rotation or by translation, or by rotation and translation.

Advantageously, the primary element comprises two at least partially superposable parts, a part, a so-called "lower part", at which the lower recess is located, and a part, a so-called "upper part", at which the upper recess is located.

It should then be understood that when the screw is tilted towards the rail by the action of the tilting means, in this case it is rather the upper part which slides (which is pushed) towards the rail.

According to the invention, the screw of the secondary element may be a hexagonal head screw or a rectangular head screw.

Preferably, the rectangular screw head has a rectangular base with a certain width and a square base of smaller width, located above said rectangular base, i.e. between the rectangular base and the body of the screw.

In a particularly advantageous way, the device according to the invention comprises at least two upper recesses and two lower recesses.

The invention also relates to a half-clip for a (flexible) device intended for fastening a railway rail to a support corresponding to the lower part or to the upper part as defined above.

According to another aspect of the invention, there is provided a screw for a (flexible) device for fastening a railway rail onto a support, comprising a screw body and a rectangular screw head. The rectangular screw head has a rectangular base having a certain width (length) and a square base of smaller width, located above said rectangular base, i.e. between the rectangular base and the body of the screw.

According to still another aspect, there is provided a half-clip, being the upper part or the lower part of the primary element as identified hereinabove.

The invention also relates to uses of the device and/or the half-clip and/or the screw as identified hereinabove in installations comprising (rails and) (harbor) cranes and/or bridge cranes.

The invention also covers an assembly comprising at least one fastening device as mentioned above and a railway rail and/or a support for said rail, and/or a pad.

By "pad" is meant a continuous strip, generally in rubber, which is placed under the support of the rail.

It may be noted that in an even more general way, the tilting means, which have the function of pushing the (upper part of the) primary element towards (against) the rail, may also be located on other elements of this assembly (not only at the fastening device alone), notably for example at the support of the rail (as a compressible shim or a spring, placed under the support, for example).

SHORT DESCRIPTION OF THE FIGURES

FIG. 1 corresponds to a perspective view of a fastening device according to an embodiment of the invention, mounted and being mounted (exploded view) on the rail and its support, and which comprises a lower part, an upper part and nut and bolt fasteners.

FIG. 2 corresponds to a side view of the device mounted on the rail.

FIGS. 3, 4, and 5 to 7 correspond to a perspective, top and side view of this same device, respectively.

FIGS. 8*a* and 8*b* correspond to a perspective view and a side view of the upper part of this device, respectively.

Figure 13A:
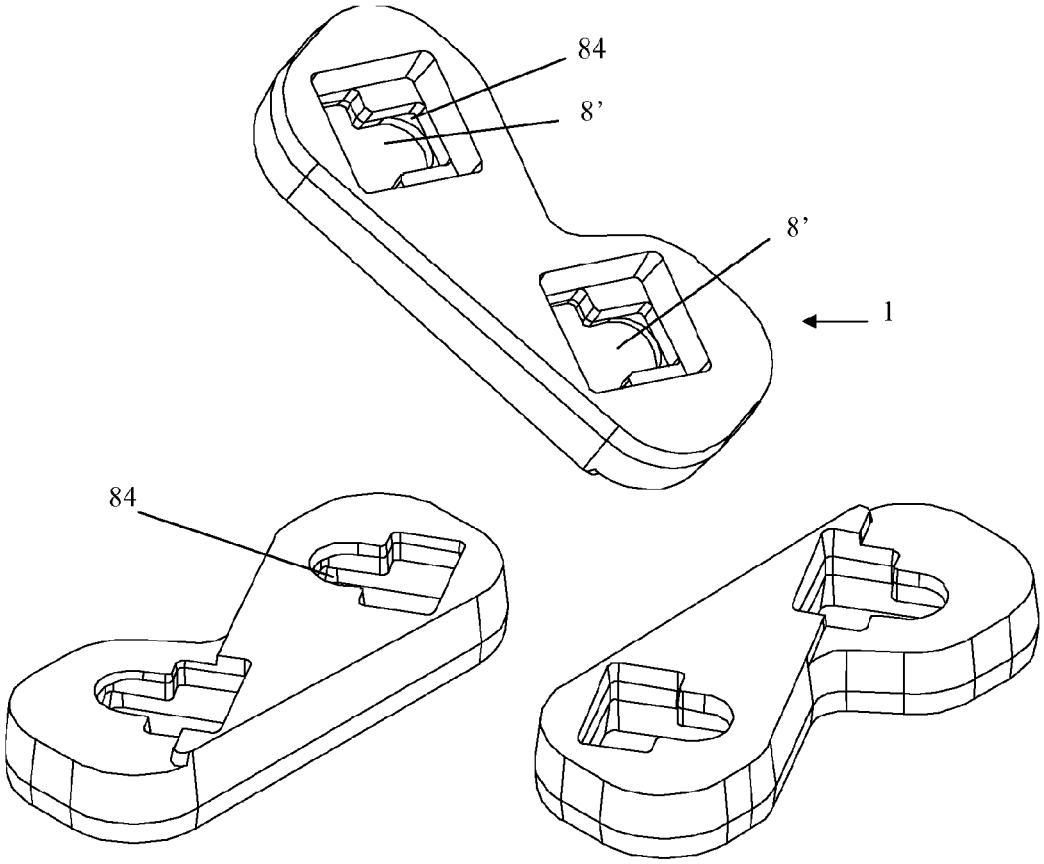

FIG. 13*a* shows different perspective views of this same lower part under different angles.

Figure 13B:
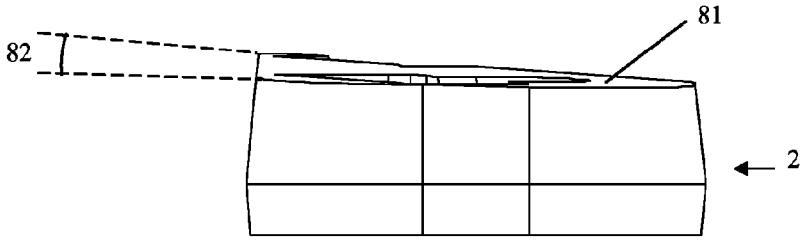
Figure 13C:
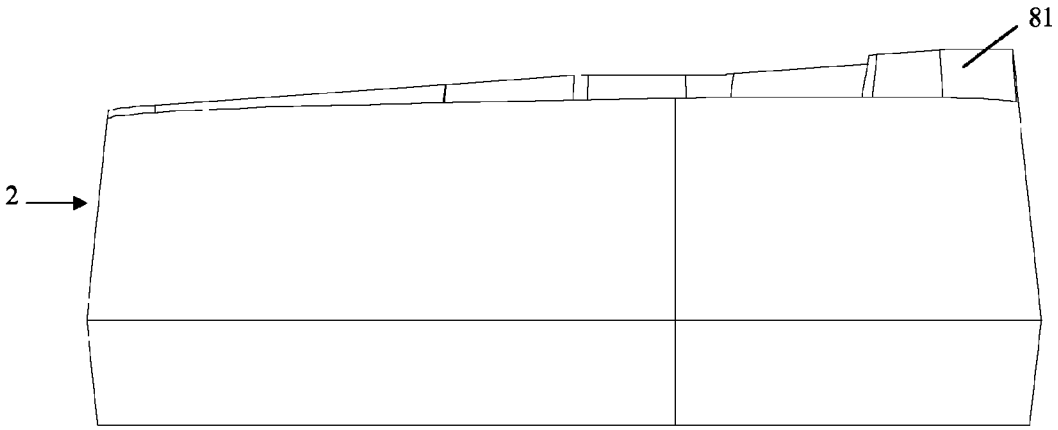

FIGS. 13*b* and 13*c* are side views of an upper part of the device according to the invention intended to more distinctly show the tapered form which is found therein.

Figure 14:
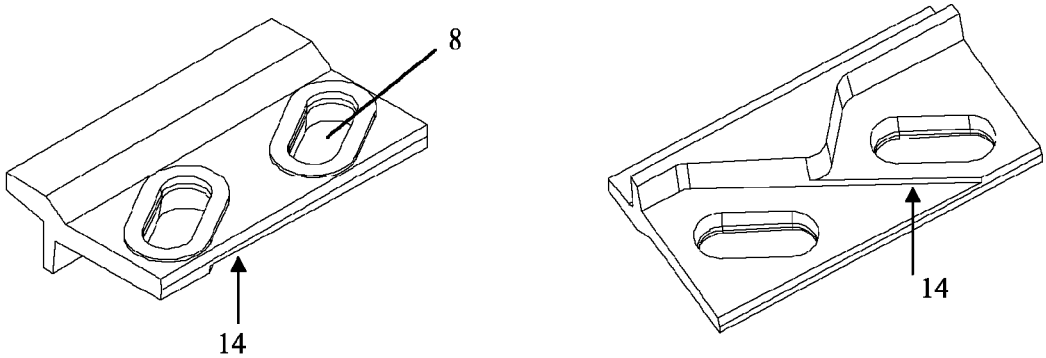

FIG. 14 shows a top and bottom perspective view of an upper part of a device according to the invention.

Figure 15:
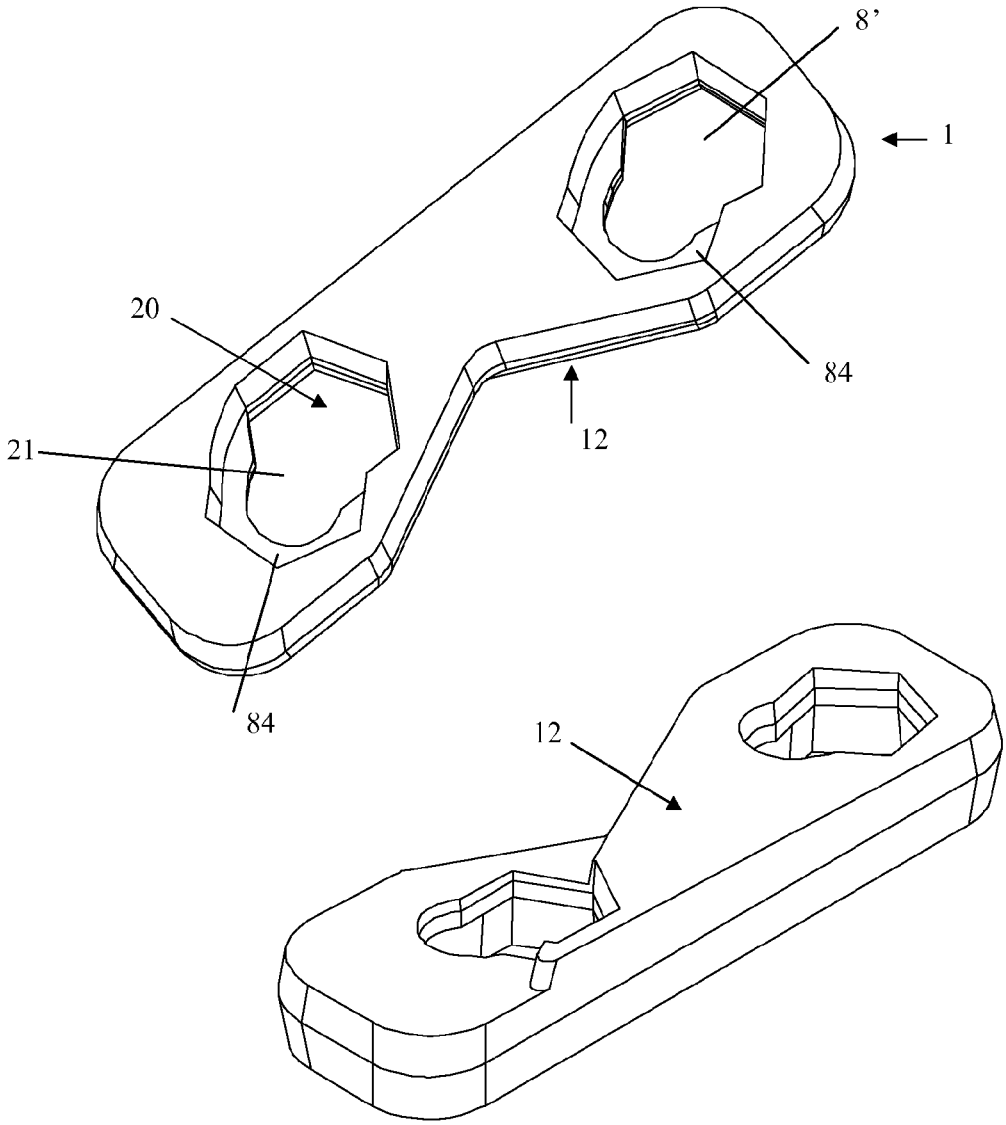
Figure 18:
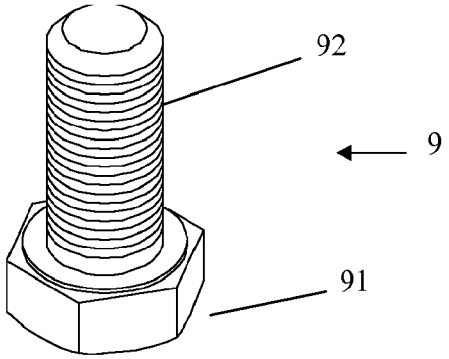

FIG. 15 shows a top and bottom perspective view of a lower part according to another embodiment of a device of the invention, the recesses of which are adapted in order to receive hexagonal head screws as illustrated in FIG. 18.

Figure 16:
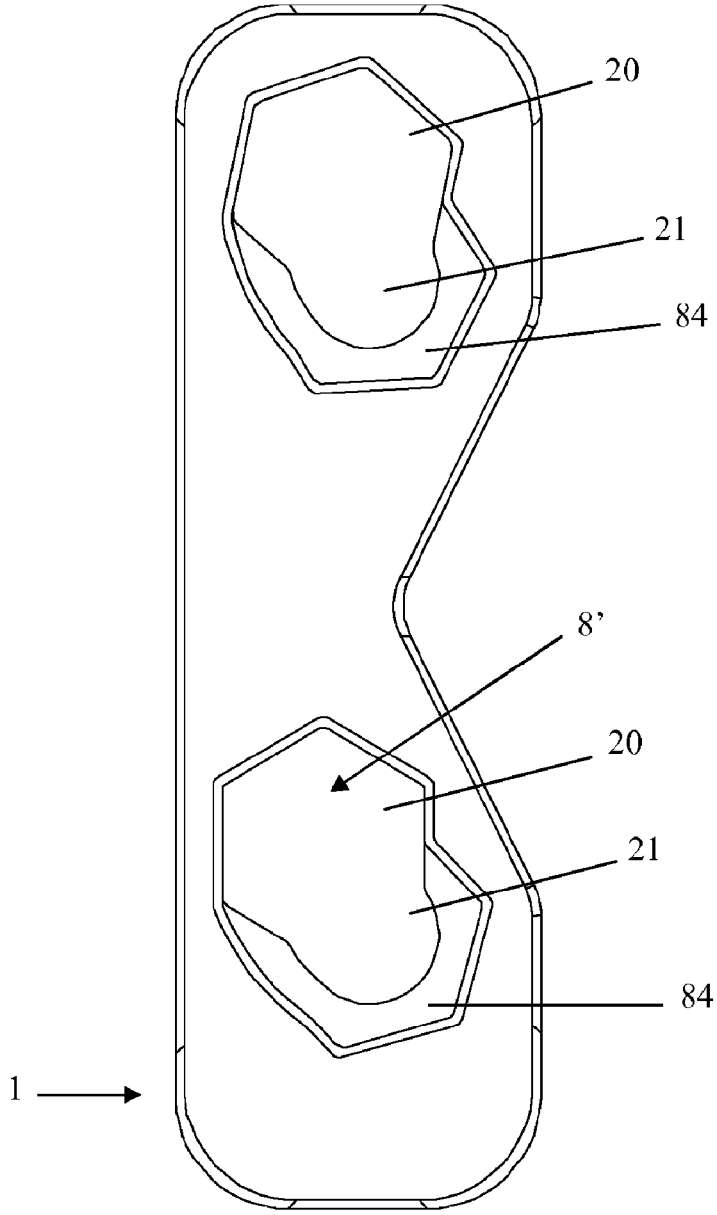

FIG. 16 corresponds to a top view of this same part.

Figure 17:
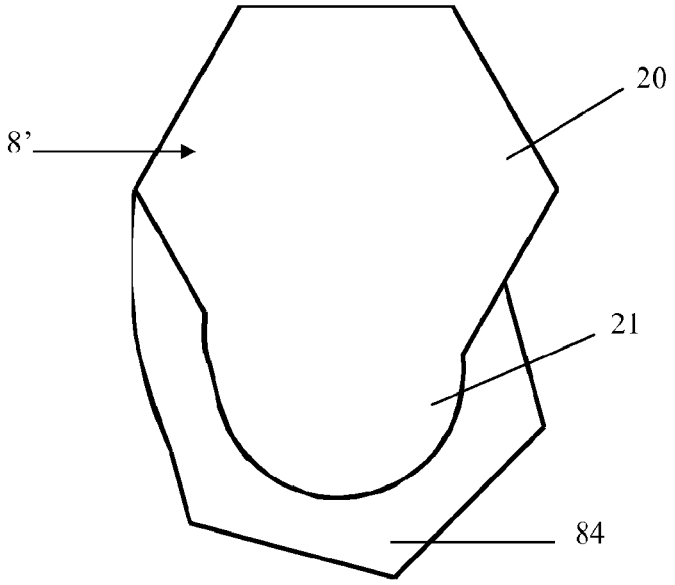

FIG. 17 shows a detail of one of the recesses of the part.

FIG. 18 is a perspective view of a hexagonal head screw for use in the device of FIG. 15

DETAILED DESCRIPTION OF THE INVENTION

Embodiments of the present invention will now be described in detail with reference to the attached figures, the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention. Those skilled in the art can recognize numerous variations and modifications of this invention that are encompassed by its scope. Accordingly, the description of preferred embodiments should not be deemed to limit the scope of the present invention.

Furthermore, the terms first, second and the like in the description and in the claims are used for distinguishing between similar elements and not necessarily for describing a sequential or chronological order. It is to be understood that the terms so used are interchangeable under appropriate circumstances and that embodiments of the invention described herein are capable of operation in other sequences than described or illustrated herein.

Moreover, the terms top, bottom, left, right, over, under and the like in the description and the claims are used for descriptive purposes and not necessarily for describing relative positions. The terms so used are interchangeable under appropriate circumstances and embodiments of the invention described herein can operate in other orientations than described or illustrated herein. For example, "left" and "right" of an element indicates being located at opposite sides of this element.

It is to be noticed that the term "comprising" should not be interpreted as being restricted to the means listed thereafter; it does not exclude other elements or steps. Thus, the scope of the expression "a device comprising means A and B" should not be limited to devices consisting only of components A and B. It means that with respect to the present invention, A and B are relevant components of the device.

Where numerical values are given with regard to limitations of a quantity, or the outcome of a measurement, for the assessment of those values, account shall be taken of variations due to impurities, methods used to determine measurements, human error, statistical variance, etc.

Where a range of numerical values is defined as extending between a lower limit and an upper limit, the range is to be construed as including said lower limit and said upper limit, unless otherwise noted.

Figure 1:
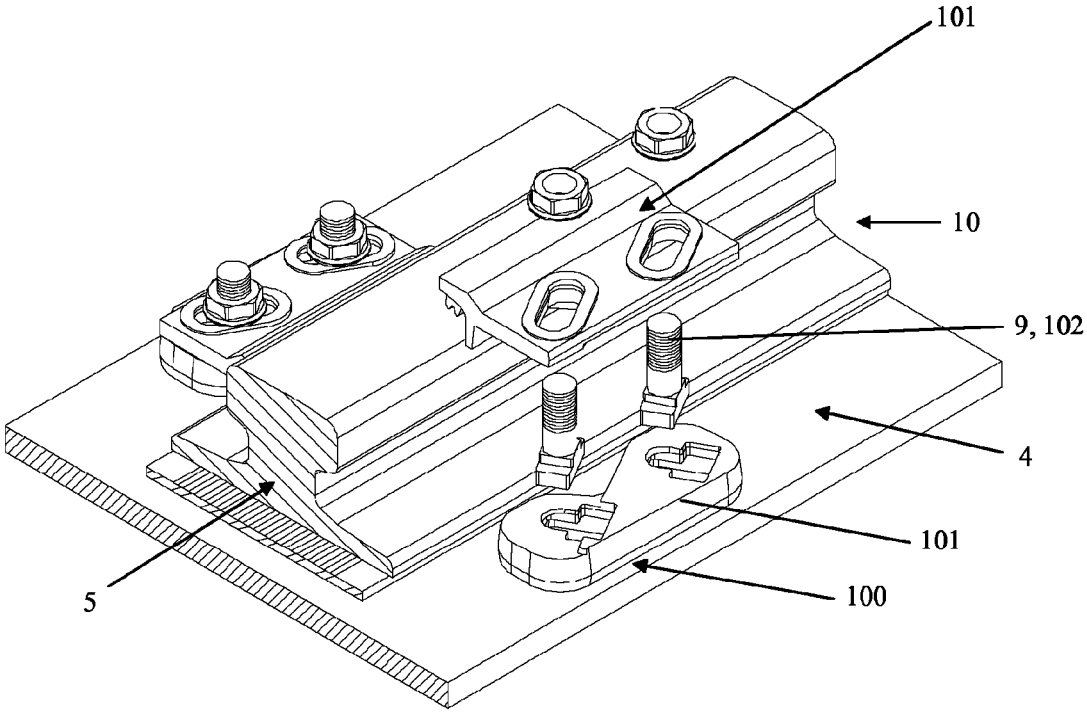
Figure 2:
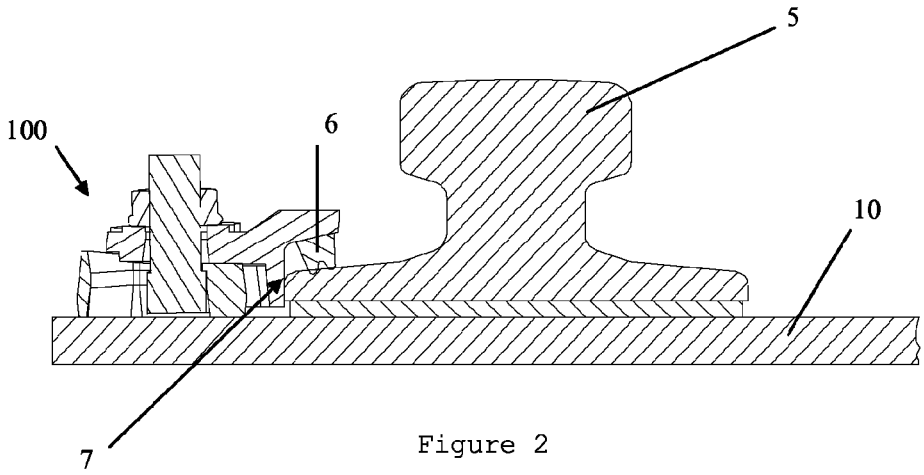
Figure 3:
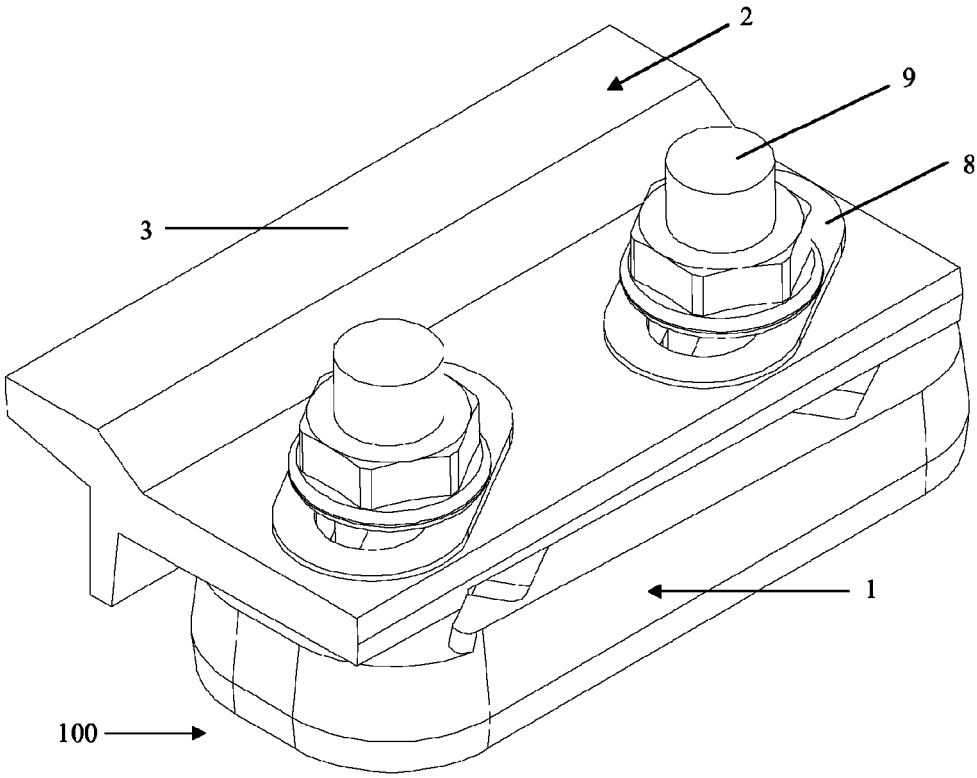
Figure 4:
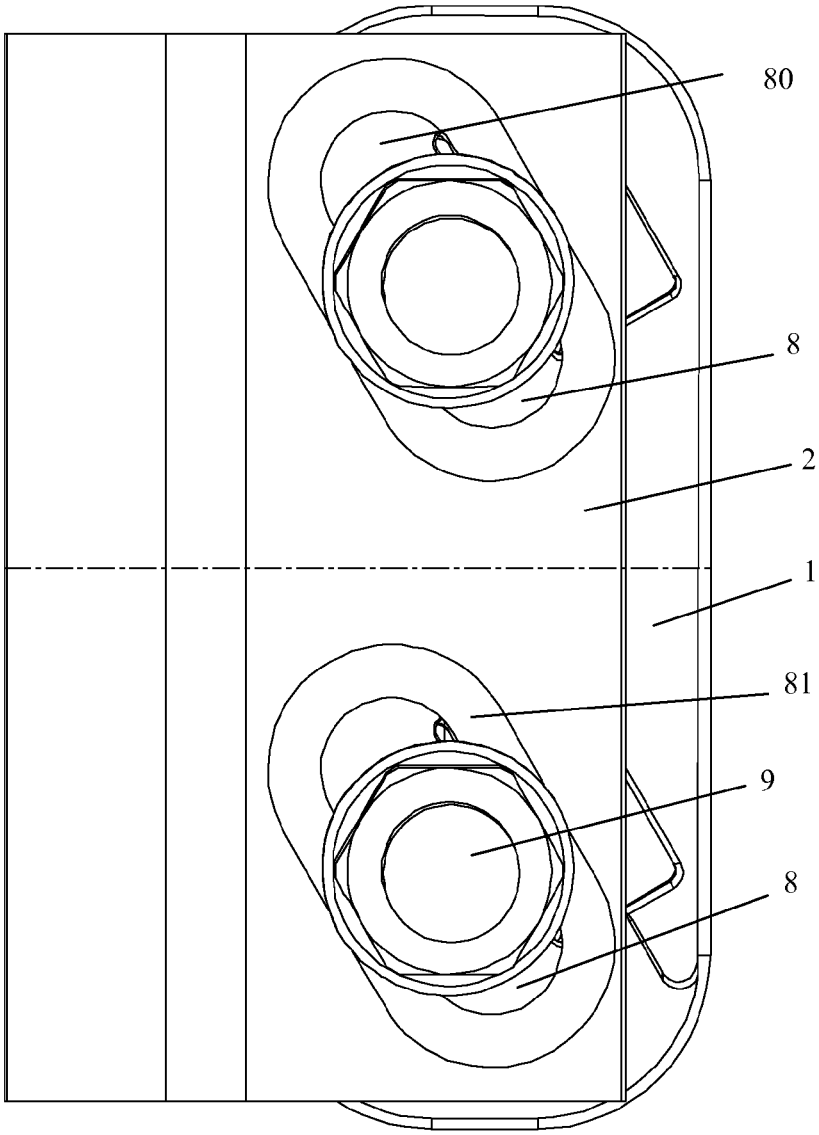
Figure 5:
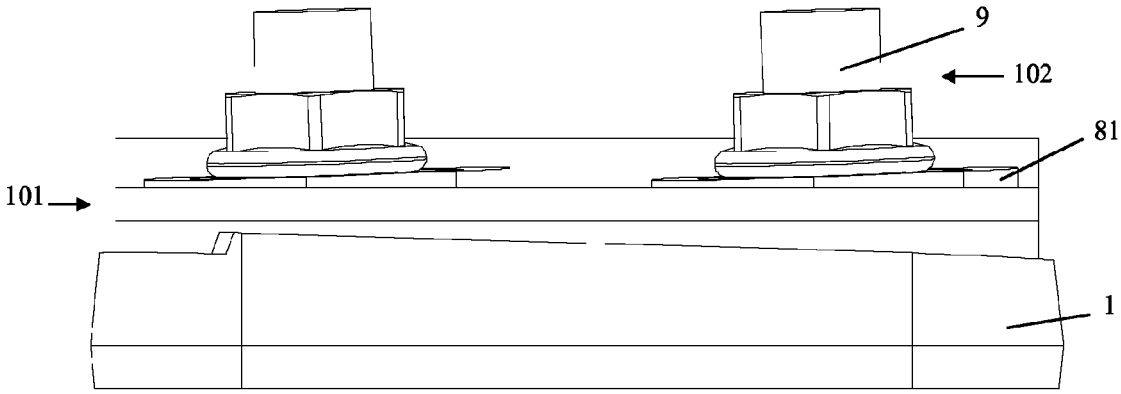
Figure 6:
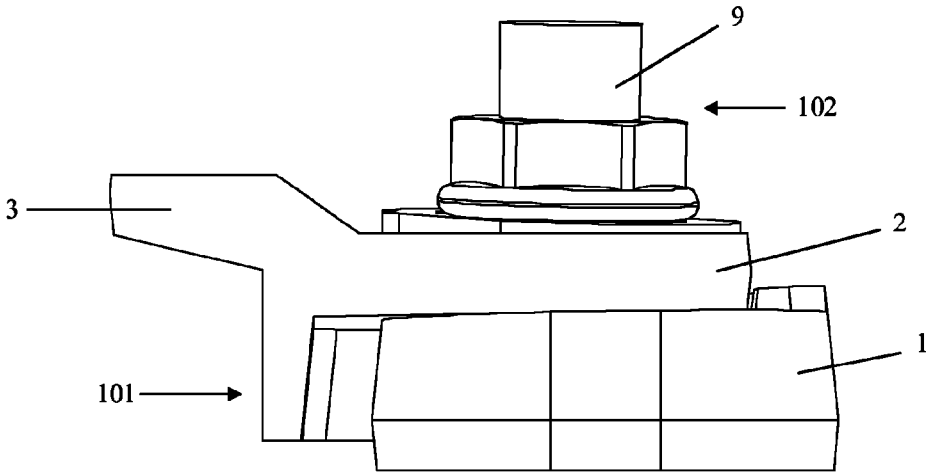
Figure 7:
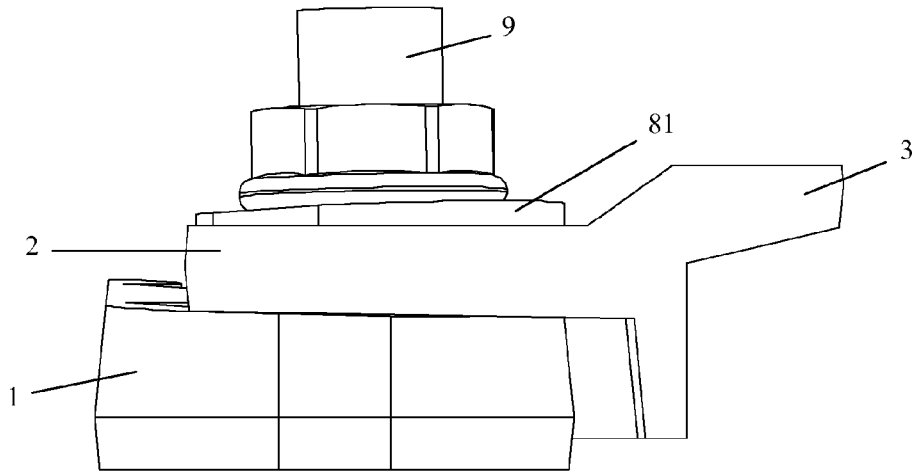
Figure 8A:
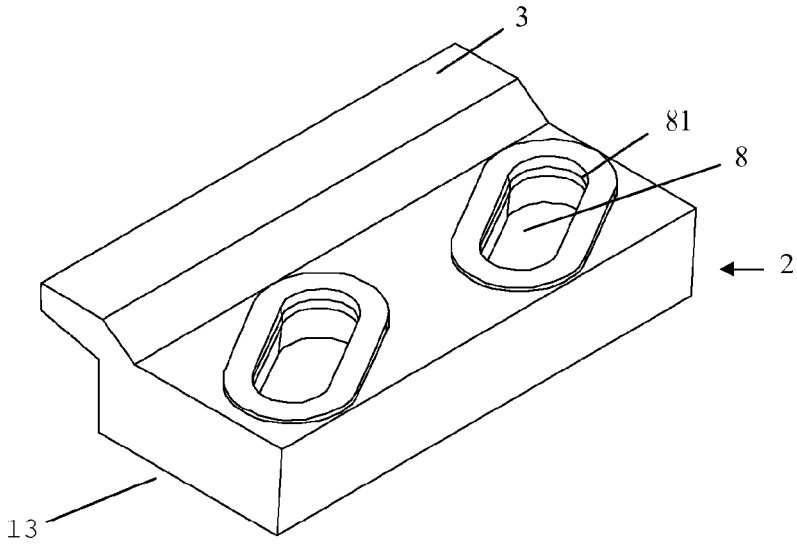
Figure 8B:
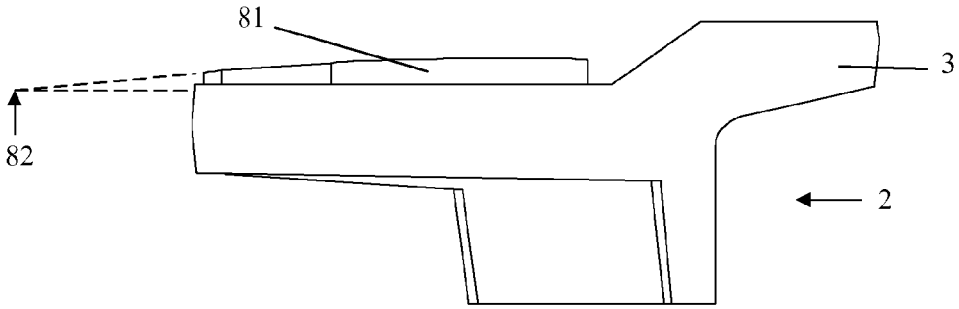
Figure 9:
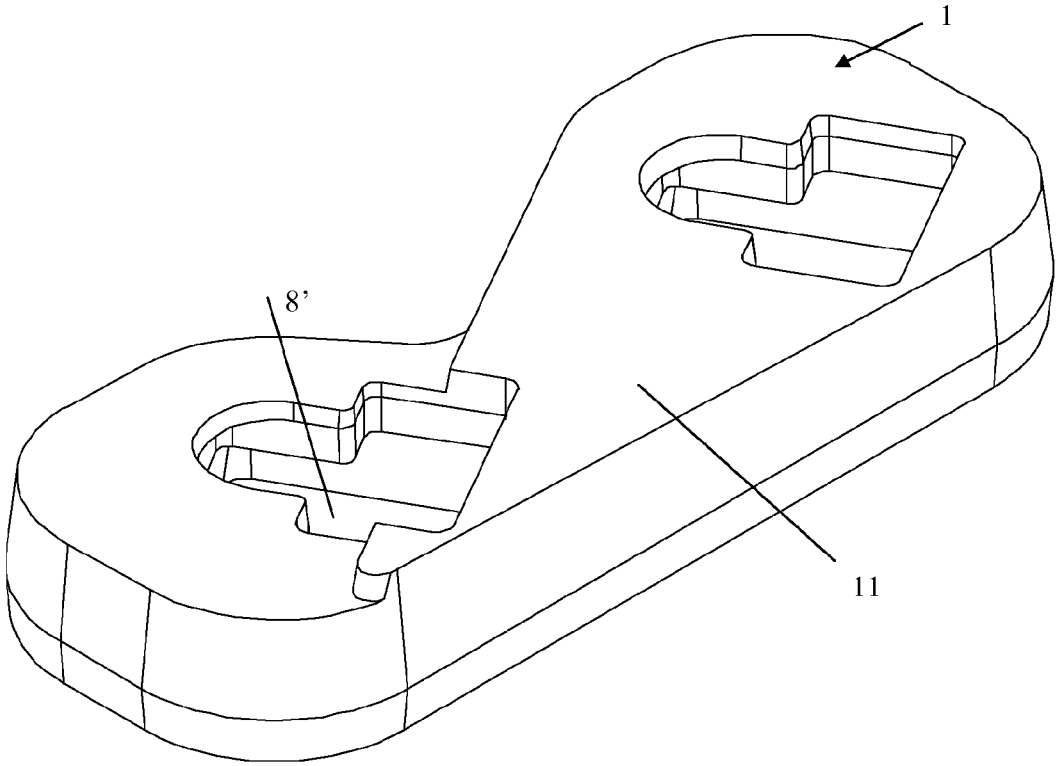
FIG. 9 shows a perspective view of a lower part of the device, the recesses of which are adapted in order to receive rectangular head screws such as those illustrated in FIG. 10.

Reference will first be made to FIGS. 1 and 2 which generally show, in view to their use, how the different elements (different parts) of a fastening device according to the invention are laid out relatively to each other and relatively to a support 4, to a rail 10 and notably to its sole 5.

As illustrated by the figures, the device 100 for fastening a railway rail 10 onto a support 4 according to the invention, comprises at least one primary element 101 designed for confining the sole or the foot 5 of the rail 10 and a secondary element 102 which allows the primary element 101 to be fastened to the support 4.

According to the invention, the primary element 101 may either consist of a single and same part, or consist of two superposable parts corresponding to a lower part 1 (first part) and an upper part 2 (second part). In the latter case, the secondary element 102 has also the function of firmly fastening the parts 1 and 2 of the primary element 101.

In the figures, examples of devices are illustrated, wherein the primary element 101 comprises two parts 1 and 2, but it should therefore be understood that it is possible that the parts 1 and 2 may be formed of a single part.

According to a first embodiment of the invention, the fastening device repeats the main characteristics of the fastening device described in patent BE-843.657 and further has technical characteristics which are specific to it.

When the fastening device is mounted on the rail, i.e. under operating conditions, the upper part 2 is superposed onto the lower part 1. The lower part (first part) 1 is supported on the support 4 and is firmly fixed thereon by bolting or welding. The upper part (second part) 2 allows confinement of the rail 10, and more particularly of the sole or the foot 5 of the rail 10 at different levels. The second part 2 has a side surface 7 capable of coming into contact with the side face of the foot 5 of the rail 10 on the one hand. On the other hand, the second part 2 has a portion 3 designed for overhanging and coming into contact with the sole or the foot 5 of the rail 10 via an elastic member 6 (elastomeric nose) so as to restrict the vertical movements of the rail 10 while providing the device with some flexibility.

The upper surface 11 of the first part 1 is inclined according to a first slope 12 with a certain angle called an inclination angle so that, when the device 100 is in the operating position, the inclination (high position towards the low position) is oriented towards the rail. Preferably, this inclination angle is comprised between 1 and 45°, preferably between 1 and 30°, and preferably between 1 and 15°, and preferably between 5 and 45°, preferably between 5 and 30°, and preferably between 5 and 15° (with reference to the horizontal, or to the base plane of part 1, i.e. the plane of the support 4).

Angles of inclination of a plane are to be measured in a plane perpendicular to the longitudinal direction of the rail.

The lower surface 13 of the second part 2 (i.e. in fact the base of the part 2) is inclined by a certain angle according to a second slope 14 which corresponds to a mirrored inclination angle of the upper surface 11 of the first part 1, so that when the device 100 is in the operating position, the inclination of this surface 13 is oriented in the direction of the rail and that the lower surface 13 of the second part 2 establishes optimum contact with the upper surface 11 of the first part 1.

Preferably, this inclination angle is comprised between 1 and 45°, preferably between 1 and 30°, and preferably between 5 and 45°, preferably between 5 and 30°, and preferably between 5 and 15° (with reference to a same reference plane as for the slope 12).

It should therefore be understood that the first slope 12 and the second slope 14 are complementary (compensate each other) and that the primary element 101 is essentially oriented parallel (in the direction of its length) to the support 4 of the rail 10 when it is in the operating position (i.e. when it is mounted on the rail).

This complementarity of the slopes 12 and 14 with the elastic member 6 contributes to providing the fastening device according to the invention with an essentially vertical resistant force with which the rail 10 may be fastened to its support 4 with relative effectiveness.

It also has the effect of bringing the clip back against the rail and of reducing the play between both parts.

Further, each part 1, respectively 2, of the primary element 101 has at least one recess (housing) 8', respectively 8, intended for receiving a screw 9 from the nut and bolt fasteners forming the secondary element 102 of the fastening device 100, with the aim of firmly fastening the first part 1 and the second part 2 of the primary element 101.

In the exemplary embodiments illustrated by the figures, each part 1, respectively 2, comprises two housings 8', respectively 8.

The recess 8' located on the lower part 1 is configured to receive the head of the screw 9, whereas the recess 8 is crossed by the body of this screw 9.

Different types of screws 9 may be used in the device according to the invention. Thus for example, either a hexagonal head screw or a screw 9 with a rectangular head may be used.

The shape of the recess 8' located on the lower part 1 is preferably adapted to one type of screw. FIGS. 1, 9, 11, 12 and 13*a* give an example of a fastening device, the recess 8' of which is adapted to rectangular head screws 9, whereas FIGS. 15 to 17 give an example of a fastening device, the recess of which 8' is adapted to screws 9 having a hexagonal head, the recess 8' then having an arched shape (arc shape).

It may be noted that embodiments of the device using hexagonal head screws may provide a specific solution to the problem of bulkiness encountered in the fastening devices of the prior art.

Comparatively, embodiments of the device using rectangular head screws, because the contact surfaces between the screw head and the recess 8' are optimized therein, facilitate and secure tightening of the screws 9 and therefore facilitate and secure assembling of the elements of the device.

The recess 8' of the first part 1 (lower part) has in its thickness one or more abutments 84 which allow the screw head 9 to be blocked after having been introduced therein.

More specifically, the recess 8' has an introduction area 20, through which the screw 9 is introduced into the recess 8' in an initial position 20, and a tightening area 21, corresponding to a final position 21 of the screw 9, which allows blocking and therefore secure tightening of said screw 9, when the latter is positioned therein.

Passing the screw 9 into the recess 8' from the introduction area 20 (initial position 20) to the tightening area 21 (final position 21) may be accomplished in different ways: either by simple translation, or by rotation, or by rotation and translation.

In the case of an arched shape of the recess 8', by this movement of the screw into the recess 8' and by the actual arched shape of the recess 8', the screw 9 is spontaneously (automatically) pushed into the bottom of the recess 8' (tightening area and final position 21).

Blocking of the screw 9 in the tightening area 21 of the recess 8' is provided by the presence of the abutments 84 against which the screw 9 will abut so as to be blocked therein.

Figure 10:
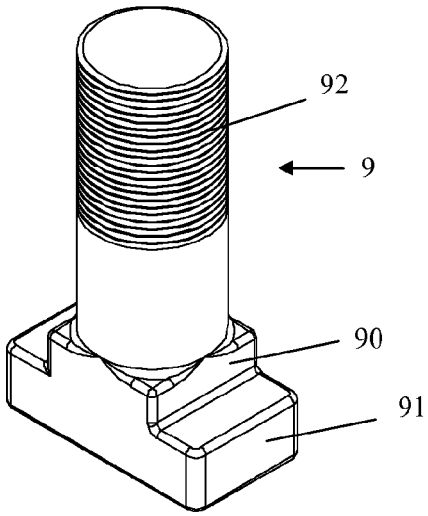
FIG. 10 is a perspective view of a rectangular head screw for use in the device of FIG. 9.
Figure 11:
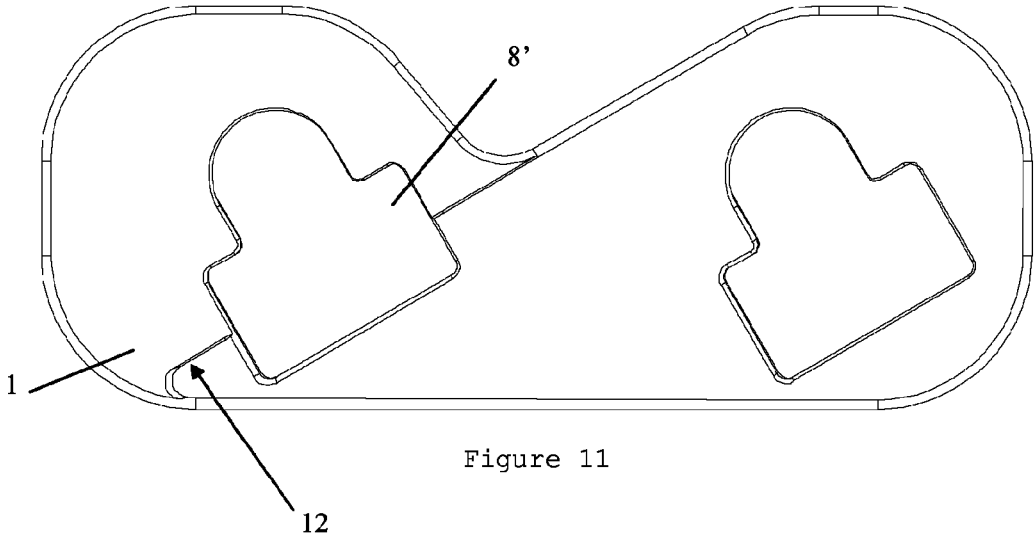
FIGS. 11 and 12 show a bottom and top view of this same part, respectively.
Figure 12:
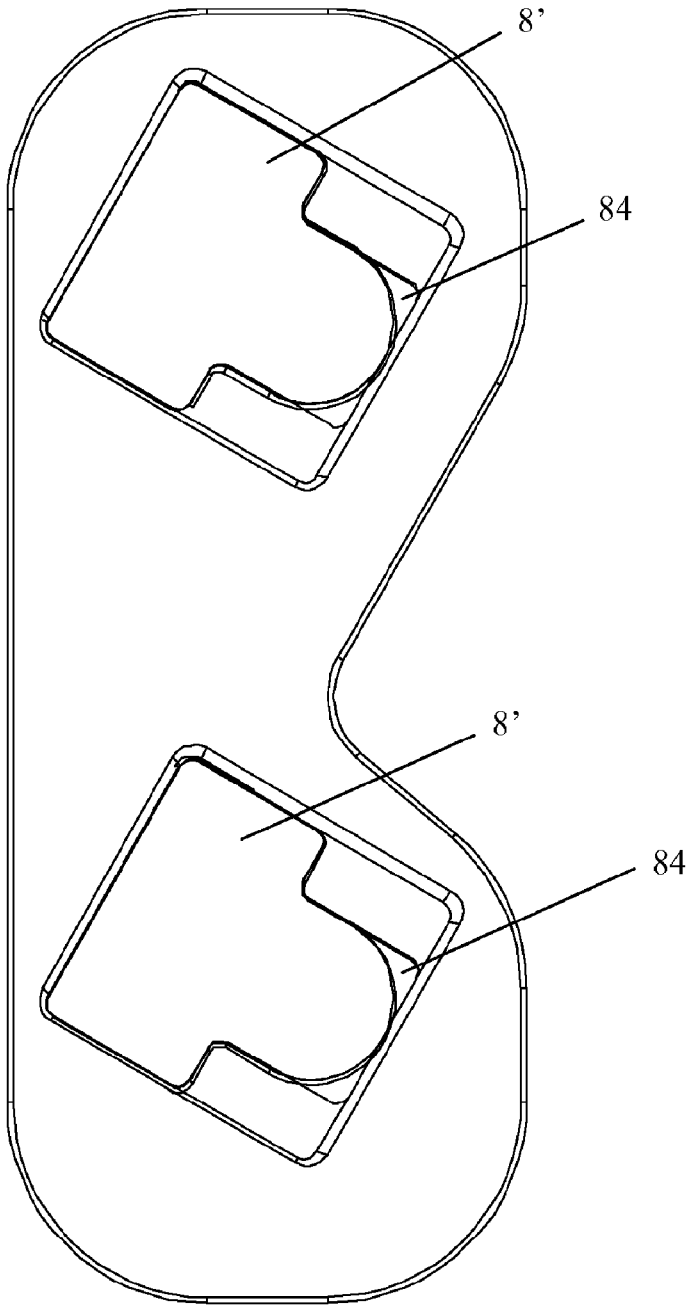

Moreover provision may be made for using for this purpose specially designed rectangular head screws in order to optimize the contact surfaces between the screw head and the recess 8', such as for example the one illustrated by FIG. 10. The latter have the particularity of having a screw head with a square base 90 located above the rectangular base 91, i.e. between the rectangular base 91 and the actual body 92 of the screw 9 (reinforcement of the blocking effect of the abutments 84 by using adapted screws 9).

In a particularly interesting way, in this device, but in a general way in all the fastening devices according to the invention, the recess 8 of the second part 2 of the primary element 101 has at the surface, i.e. at the upper surface 15 of the second part 2, a tilting element 81 having a slope 82 of a certain angle oriented in such a way that in the operating position, the tilt of the element 81 is turned in the opposite direction to the rail 10. The tilt of the slope 82 is such that it creates a horizontal component at the force which is exerted on the screw under operating conditions. In this way, in the operating position, this screw 9 and the second part 2 of the primary element 101 are held against the rail 10. Preferably, the tilt angle of the slope falls in the range between 1 and 45°, preferably between 1 and 30°, and preferably between 1 and 15°, preferably 5 and 30°, and preferably between 5 and 15° (with reference to the horizontal, or to a base plane of part 1 or a plane formed by the support 4).

The tilt of this screw 9 under the effect of the tilting element 81 has the effect of sliding (pushing) the primary element 101, and more particularly the upper part 2, towards the rail.

It is meant by tilting of the screw the tilting (leaning) of the screw head in the direction of the rail and the tilting (leaning) of the screw body in the direction opposite to the rail.

The tilting element is a means for tilting the screw. The tilting element forces the screw (and the nut) to take such an orientation that the screw axis is perpendicular to the plane of the slope 82. As a result, the srew axis is tilted over an angle which preferably falls in the range between 1 and 45°, preferably between 1 and 30°, and preferably between 1 and 15°, preferably 5 and 30°, and preferably between 5 and 15° (with reference to the vertical, or to a line perpendicular to the base plane of part 1 or of the support 4). The tilt angle is to be measured in a plane perpendicular to the longitudinal direction of the rail.

In the embodiments wherein the device has at the parts 1 and 2 of the primary element 101, slopes 12 and 14, as for example the embodiments repeating the essential characteristics of the device described in patent BE-843.657, the tilt of the slope 82 of the element 81 may be selected according to that of the slopes 12 and 14.

More generally, according to the embodiments, the tilt angle of the element 81 (slope 82) can be chosen either in an independent manner or in a dependent manner from the tilt angle of the slopes 12 and 14.

The tilting element 81 may assume different shapes depending on the device, provided that this tilting element 81 has a slope 82 and that the same technical effect is obtained (creation of a horizontal component at the force being exerted on the screw 9 under operating conditions).

The tilting element 81 may either be an integral part of the part 2 (same composition), or be an integral element of the part 2 (same composition or different composition).

The tilting element 81 may thus for example assume the shape of a bulge located on the edges of the recess 8, as illustrated in the figures.

The tilting element 81 may also for example assume the shape of a spring, for example located on the edges of the recess 8.

Further, the orientation of the recess 8 at the part 2 may also be selected depending on the relative orientation of the surface 13 of the part 2 and of the surface 11 of the part 1, so that with the tilting element 81, it contributes to the tilting effect of the screw in the direction (towards) the rail.

The figures give an example of orientation of the recess 8 for a device similar to the device described in patent BE-843.657.

In these figures, the recess 8 thus has the characteristic of having an aperture 80, the main axis of which is shifted by a few degrees with respect to the perpendicular to the base of the first part 1 (lower part), which contributes to the lateral tilting effect of the screw 9 against the rail 10 on the one hand, and of the second part 2 of the primary element 101 on the other hand. The recess 8 is also oriented parallel to the plane of the slope 14.

In addition to their blocking function, the abutments 84 at the recess 8 may also have a tilting (orientation) function of the screw 9 against the rail 10 which will then be added to that of the tilting element 81 (by creating a horizontal component at the force which is exerted on the screw 9 under operating conditions).

For example, for this purpose, the abutments 84 may have a tilt which may be selected in a tilt plane parallel to that of the slope 82 of the tilting element 81.

As already mentioned earlier, according to an embodiment of the device according to the invention, the first part 1 and the second part 2 of the primary element 101 may have more than one recess 8, i.e., two, three recesses, or even more if necessary, so as to provide greater fastening effectiveness of the rail 10 to its support 4.

It will be noted that the side surface of the second part of the primary element, which overhangs and comes into contact with the sole or the foot of the rail, may have an elastomeric nose 6. The presence of this nose allows some vertical flexibility, particularly adapted to absorbing stresses induced by the passing of rollers of the vehicles railway on the rail. In other words, by means of these clips, the rail is not totally restrained, since it is firmly held sideways but it retains the capability of moving vertically in certain proportions.

The use of a continuous rubber strip called a pad which is placed under the support of the rail, together with that of these clips, contributes to providing, under operating conditions, some vertical flexibility of the rail and to thus obtaining flexible fastening of the rail.

The invention claimed is:

1. A device for fastening a railway rail onto a support, the device comprising a primary element and a secondary element, wherein the secondary element corresponds to nut and bolt fasteners comprising at least one nut and one screw with a screw body and a screw head, the primary element comprises a lower part and an upper part being at least partially superposable, each of said parts having an upper surface and a lower surface, said parts being crossed in their thickness by at least one aperture adapted to receive said screw, said aperture being formed by a first recess located on the upper part and configured for receiving the screw body of said screw, and a second recess located on the lower part and configured for receiving the screw head and wherein:

the upper surface of the lower part is inclined according to a first slope and the lower Surface of the upper part is inclined according to a second slope, the first slope and the second slope being complementary, and the upper part comprises a tilting element for tilting the screw, said tilting element being located on the edges of the first recess, wherein the tilting element of the screw is configured to tilt the screw over an angle falling in the range between 1° and 45° with reference to a line perpendicular to a plane formed by the support.

2. The device according to claim 1, wherein the tilting element of the screw is configured to tilting the screw over an angle falling in the range between 1° and 30° with reference to a line perpendicular to a plane formed by the support.

3. The device according to claim 2, wherein the tilting element of the screw is configured to tilting the screw over an angle falling in the range between 1° and 15° with reference to a line perpendicular to a plane formed by support.

4. The device according to claim 1, wherein the tilting element of the screw is configured to tilting the screw over an angle falling in the range between 5° and 45° with reference to a line perpendicular to a plane formed by support.

5. The device according to claim 4, wherein the tilting element of the screw are configured to tilting the screw over an angle falling in the range between 5° and 30° with reference to a line perpendicular to a plane formed by the support.

6. The device according to claim 5, wherein the tilting element of the screw is configured to tilting the screw over an angle falling in the range between 5° and 15° with reference to a line perpendicular to a plane formed by the support.

7. The device according to claim 1, wherein the inclination angle of the first slope falls in the range between 1° and 45° with reference to a plane formed by the support.

8. The device according to claim 7, wherein the inclination angle of the first slope falls in the range between 1° and 30° with reference to a plane formed by the support.

9. The device according to claim 8, wherein the inclination angle of the first slope falls in the range between 1° and 15° with reference to a plane formed by the support.

10. The device according to claim 7, wherein the inclination angle of the first slope falls in the range between 5° and 45° with reference to a plane formed by the support.

11. The device according to claim 10, wherein the inclination angle of the first slope falls in the range between 5° and 30° with reference to a plane formed by the support.

12. The device according to claim 11, wherein the inclination angle of the first slope falls in the range between 5° and 15° with reference to a plane formed by the support.

13. The device according to claim 1, wherein the inclination angle of the first slope and the tilt angle of the screw by the tilting element are chosen independently from each other.

14. The device according to claim 1, wherein the inclination angle of the first slope and the tilt angle of the screw by the tilting element are chosen in a dependent manner on each other.

15. The device according to claim 1, wherein the tilting element is an integral part of the upper part.

16. The device according to claim 1, wherein the tilting element forms one or several parts, different from the upper part.

17. The device according to claim 15, wherein the tilting element assumes the shape of a bulge located on the edges of the first recess.

18. The device according to claim 1, wherein the screw has a rectangular head, the rectangular head of the screw comprises a rectangular base and a square base having smaller side length than the length of the rectangular base, the square base located between the rectangular base and the body of the screw.

19. A device for fastening a railway rail onto a support, the device comprising a primary element and a secondary element, wherein the secondary element corresponds to nut and bolt fasteners comprising at least one nut and one screw with a screw body and a screw head, the primary element comprises a lower art and an upper part being at least partially superposable, each of said parts having an upper surface and a lower surface, said parts being crossed in their thickness by at least one aperture adapted to receive said screw, said aperture being formed by a first recess located on the upper part and configured for receiving the screw body of said screw, and a second recess located on the lower part and configured for receiving the screw head and wherein:

the upper surface of the lower part is inclined according to a first slope and the lower surface of the upper part is inclined according to a second slope, the first slope and the second slope being complementary, and the upper part comprises a tilting element for tilting the screw, said tilting element being located on the edges of the first recess, wherein the second recess comprises abutments configured for blocking the head of the screw when the device is mounted.

20. The device according to claim 19, wherein said abutments are configured to co-operate with the tilting element in order to tilt the screw over a same angle with an abutment angle and a tilting angle being the same.

21. The device according to claim 20, wherein the tilting element and the abutments each comprise a tilted plane, the tilted planes being parallel to each other when the device is in an operating condition.

22. A device for fastening a railway rail onto a support the device comprising a primary element and a secondary element, wherein the secondary element corresponds to nut and bolt fasteners comprising at least one nut and one screw with a screw body and a screw head, the primary element comprises a lower part and an upper part being at least partially superposable, each of said parts having an upper surface and a lower surface, said parts being crossed in their thickness by at least one aperture adapted to receive said screw, said aperture being formed by a first recess located on the upper part and configured for receiving the screw body of said screw, and a second recess located on the lower part and configured for receiving the screw head and wherein:

the upper surface of the lower part is inclined according to a first slope and the lower surface of the upper part is inclined according to a second slope, the first slope and the second slope being complementary, and the upper part comprises a tilting element for tilting the screw, said tilting element being located on the edges of the first recess, wherein the second recess comprises an introduction area, configured for introducing the screw therethrough, the screw being in an initial position, and a tightening area, configured for blocking and tightening of said screw, the screw being in a final position.

23. The device according to claim 22, wherein the introduction area and the tightening area are so configured as to impart a rotation to the screw when passing from the initial position to the final position.

24. The device according to claim 22, wherein the introduction area and the tightening area are so configured as to impart a translation to the screw when passing from the initial position to the final position.

25. The device according to claim 22, wherein the introduction area and the tightening area are so configured as to impart a rotation and a translation to the screw when passing from the initial position to the final position.

* * * * *